United States Patent [19]

Edwards

[11] 4,129,165

[45] Dec. 12, 1978

[54] PREPARATION OF FOUNDRY MOULDS AND CORES

[75] Inventor: Albert Edwards, Peterborough, England

[73] Assignee: Baker Perkins Holdings Limited, Peterborough, England

[21] Appl. No.: 847,931

[22] Filed: Nov. 2, 1977

[30] Foreign Application Priority Data

Nov. 2, 1976 [GB] United Kingdom ..... 45469/76

[51] Int. Cl.[2] ..... B22C 9/00

[52] U.S. Cl. ..... 164/7; 164/16; 164/160; 164/171

[58] Field of Search ..... 164/7, 12, 16, 21, 22, 164/160, 170, 171

[56] References Cited

U.S. PATENT DOCUMENTS

| | | | |
|---|---|---|---|
| 2,962,776 | 12/1960 | Taccone | 164/170 |
| 3,156,958 | 11/1964 | Miller et al. | 164/170 |
| 4,069,858 | 1/1978 | Edwards | 164/160 |

FOREIGN PATENT DOCUMENTS

| | | | |
|---|---|---|---|
| 338296 | 6/1972 | U.S.S.R. | 164/170 |

OTHER PUBLICATIONS

P. Schneider, "Production of Castings by Vacuum-Sealed Moulding Process Using Binderless Sand" 6/74, Foundry Trade Journal, p. 723.

*Primary Examiner*—J. Howard Flint, Jr.
*Assistant Examiner*—K. Y. Lin
*Attorney, Agent, or Firm*—Learman & McCulloch

[57] ABSTRACT

To compact a sand-binder mixture in a mould or core box and subsequently apply a hardening gas to the mixture, I apply to the open top of the box a fluid-pervious diaphragm backed by an impervious diaphragm, apply suction to the bottom of the box to draw the diaphragm against the top of the mixture and compact the mixture, and subsequently introduce the hardening gas between the diaphragms so that it passes through the first diaphragm and permeates the mixture within the box.

12 Claims, 3 Drawing Figures

PREPARATION OF FOUNDRY MOULDS AND CORES

BACKGROUND OF THE INVENTION

The present invention relates to a method of preparing a foundry form by a cold set process, comprising introducing a mixture of foundry sand and a binder into a form box, covering an open end of the form box with a sealing head comprising a flexible diaphragm, and applying suction to the form box to draw the diaphragm against a surface of the mixture to compact the mixture in the form box. The invention also relates to apparatus for carrying out the method.

The invention is primarily applicable to foundry moulds, i.e. to the forms for shaping the outside of the castings. However, the invention can also be applied to the mould cores, i.e. the forms for shaping the interior of the castings, if the cores are of such a shape as the diaphragm arrangement can be used. For this reason, the unusual terms "foundry form" and "form box" are used herein to comprise both the foundry mould and mould box, and the mould core and core box. The mould box itself can contain a pattern or can have a plain bottom, e.g. contain a plain platen, to form a flat side on the casting.

The method and apparatus referred to above are described in British Patent Specification No. 1,470,672. However, it has been found that the method and apparatus can be improved for use when applying a fluid hardening medium to harden the mixture in the form box. The fluid hardening medium is usually a gas, and can act either as a catalyst or a hardening agent. The most common such process is the $CO_2$ process in which gaseous $CO_2$ is introduced to the form box as a hardening agent to react with a sodium silicate mixture binder. However, other processes can be used, and the invention can be applied to any chemical binder system which utilizes a fluid hardening agent. For example, with certain types of resins, a catalytic hardening agent may be in the form of an acidic gas; the acid components of the gas may be normally gases or may be normally liquid and in the form of vapours, such components including sulphurdioxide, chlorine, aluminium chloride, hydrogen chloride and hydrogen bromide.

THE INVENTION

The present invention provides a method of preparing a foundry form as set forth in claim 1, and apparatus for preparing a foundry form as set forth in claim 4.

Using the invention, the initial vacuum applied to the mixture in the form box evacuates much of the air and gives the incoming hardening fluid a clear volume in which to "wash" the particles of the mixture without itself having to push out the air, and if desired, there can be a further application of vacuum to improve the penetration of the fluid hardening medium. Compared to prior art processes in which the gas was merely applied to the top of the open form box, gas usage can be reduced by $\frac{1}{3}$, and the speed with which the gas is applied can be considerably accelerated, leading also to shorter hardening periods due to better gas/particle contact.

BRIEF DESCRIPTION OF THE DRAWINGS

The invention will be further described, by way of example, with reference to the accompanying drawings, in which.

DETAILED DESCRIPTION OF THE DRAWINGS

Figure 1:
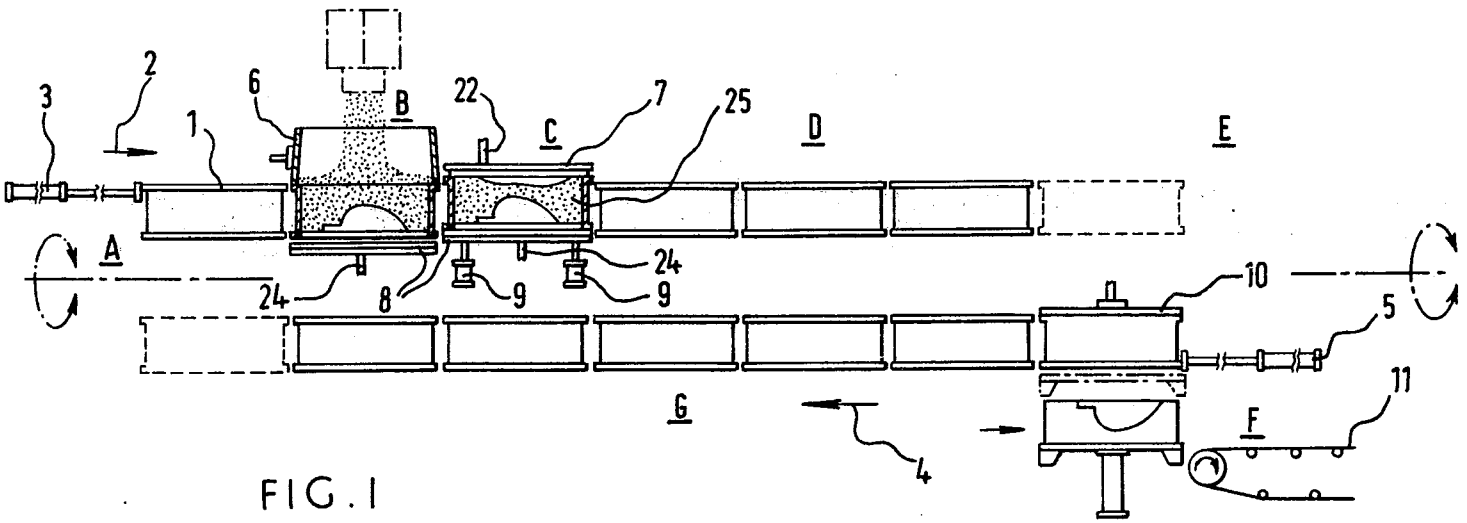
FIG. 1 is a side view of apparatus in accordance with the invention, showing parts in vertical section.

The general arrangement shown in FIG. 1 is very similar to that disclosed in British Patent Specification No. 1,470,672, and will only be described very briefly.

FIG. 1 shows an in-line foundry plant wherein mould or core boxes 1 abut each other, and are moved upright in the direction of the arrow 2 along an upper conveyor run by means of a ram 3, and are moved inverted in the direction of the arrow 4 along a lower conveyor run by means of a ram 5. The path comprises a roll-over station A, a filling station B, a compacting and gassing station C, a curing station D, a roll-over station E, a discharge station F and a return line G.

At the filling station B, each successive form box 1 is filled as described in British Patent Specifications No. 1,418,491 and No. 1,470,672, a fixed upset frame 6 being used both for filling and strickling as the form box 1 moves on.

At the compacting station C, there are upper and lower sealing means in the form of sealing heads 7 and 8, the top sealing head 7 being fixed in position slightly above the path of the form boxes 1 but the bottom sealing head 8 being vertically movable by any suitable means, for instance two small rams 9. The operation at the compacting station C is described in more detail below with reference to FIGS. 2 and 3. After compacting, curing and inversion, the completed form is discharged by compressed air applied by means of a sealing head 10 and is discharged onto a conveyor 11.

Figure 2:
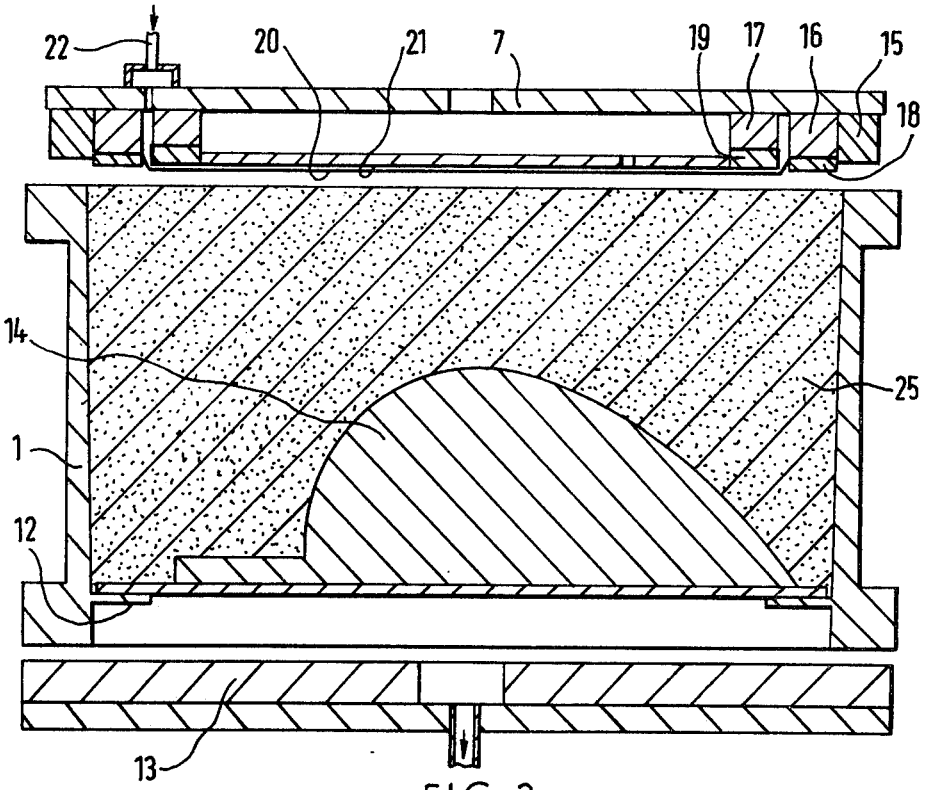
FIG. 2 is a vertical section of part of the apparatus of FIG. 1.
Figure 3:
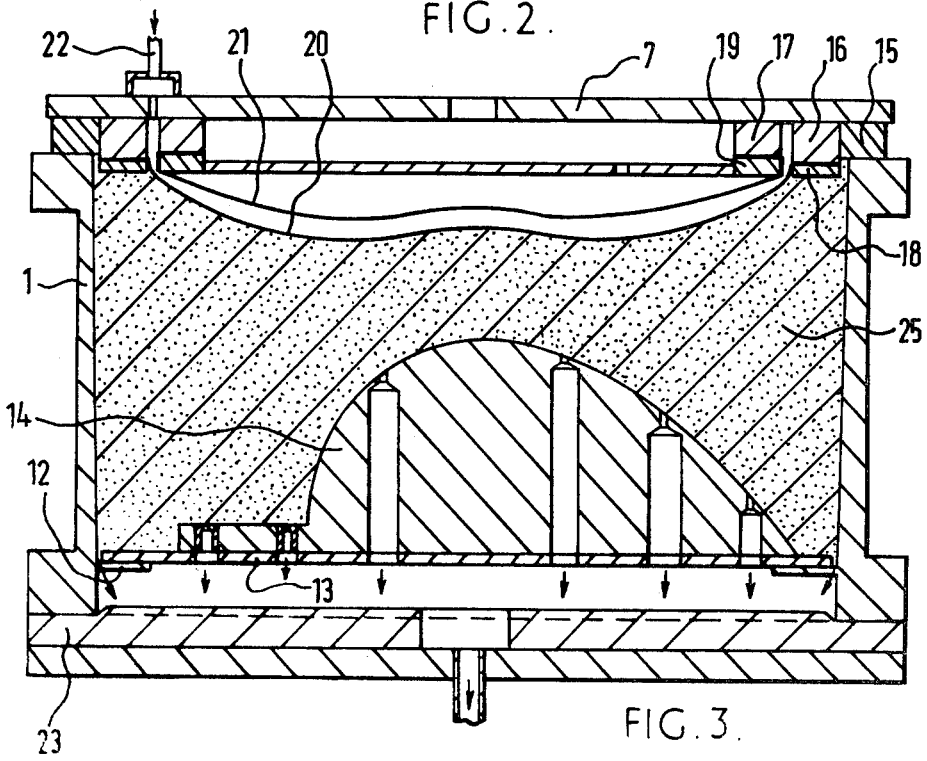
FIG. 3 is a vertical section of part of the apparatus of FIG. 1, showing a minor modification, and showing the form box when pressure has been applied to the mixture therein.

As shown in FIGS. 2 and 3, the form box 1 has an open top and bottom and its side walls have pattern plate retaining means in the form of spaced supports or lugs 12 for retaining a pattern plate 13 adjacent the bottom of the form box 1. The pattern plate 13 in the embodiment illustrated in FIGS. 2 and 3 carries a pattern 14, and the pattern plate 13 and pattern 14 may be perforated in any suitable manner, as is illustrated in FIG. 3 but not in FIG. 2. The pattern plate 13 terminates a small distance, say 1.5 mm, short of the side walls of the form box 1 so that even in FIG. 2, air can be drawn out into the bottom of the form box 1, passing around the outside of the pattern plate 13 between the lugs 12. As an alternative which is not illustrated, the perforated pattern plate 13 of FIG. 3 could be permanently fixed within the form box 1 and sealed to the side walls thereof.

The top sealing head 1 carries a soft frame-shaped seal 15 for sealing against the top of the form box 1 and first and second securing frames 16, 17. By means of respective fixing frames 18, 19 first and second diaphragms 20, 21 are secured to the top sealing head 7. The first diaphragm 20 is made of a thin, perforated elastomeric material such as rubber or synthetic rubber and the second diaphragm 21 is made of an imperforate but like material. There is a duct 22 leading to the space between the frames 16, 17 and thus to the space between the diaphragms 20, 21.

The lower sealing head 8 has a seal 23 for engaging the bottom of the form box 1 and sealing against either the main aperture formed by the bottom of the form box 1 or (in another alternative not illustrated) smaller apertures in the pattern plate 12. There is a suction duct 24. It will be noted that an identical head 8 can be mounted below the filling station B, for use in filling the form box 1.

As shown in FIG. 1, in the compacting station the rams 9 lift the bottom sealing head 8 against the bottom of the form box 1 and thus lift the form box 1 up against the top sealing head 7, sealing the form box 1 securely between the two heads 7, 8. Using a programmed valve box (not shown) suction of the order of 20 to 26 inches Hg (about 0.7 to 0.9 $Kg/cm^2$) is applied to the duct 24. This withdraws air from the sand/binder mixture 25 in the form box 1 and draws the second diaphragm 21 against the first diaphragm 20 and thus the first diaphragm 20 against the top surface of the mixture 25 to compact the mixture around the pattern 14. If desired, the vacuum can be continued, but preferably hardening gas is supplied to the duct 22 at the same time as the vacuum is cut off from the duct 24; subsequently the vacuum is re-applied to the duct 24 whilst hardening gas continues to be supplied through the duct 22, and then the vacuum and gas are cut off simultaneously. However, parameters such as the length of time of application of the vacuum and gas and the overlap can be varied as desired to achieve proper contact of the mixture 25 with the gas and avoiding gas wastage, the parameters depending on factors such as the size of the mould, the amount of gas dispersion required and the shape of the pattern, the vacuum itself only being a partial vacuum. A suitable pressure for the gas is about 1 $Kg/cm^2$, and it will be seen that when the gas is applied, the gas separates the diaphragms 20, 21 and retains the first diaphragm 21 in pressure contact with the mixture 25, thereby preventing any disturbance of the compacted mixture whilst the gas passes through the diaphragm 20 and permeates the mixture 25 and reacts with the binder to initiate setting or hardening of the mixture 25.

After sufficient gassing, the rams 9 are retracted to lower the bottom sealing head 8 and thus the form box 1, and if desired, heated air may be blown on the setting mixture to accelerate the setting time (in spite of this, the process is still called a "cold set" process).

It will be understood that the in-line plant shown in FIG. 1 could be replaced by any suitable alternative plant, such as a conventional rotary table plant.

I claim:

1. A method of preparing a foundry form by a cold-set process, comprising:

introducing a mixture of foundry sand and a binder into a form box;

covering an open end of the form box with sealing means comprising a first, fluid-pervious, flexible diaphragm backed by a second, impervious, flexible diaphragm;

applying suction to the form box to draw the second diaphragm against the first diaphragm and the first diaphragm against the surface of the mixture in the form box to compact the mixture; and subsequently introducing a fluid hardening medium between the first and second diaphragms so that it passes through the first diaphragm, permeates the mixture within the form box, and causes the binder to harden the mixture.

2. The method of claim 1, wherein suction is applied to the form box by engaging second sealing means with the opposite end of the form box and applying suction to the second sealing means.

3. The method of claim 2, wherein successive form boxes are delivered horizontally between the first and second sealing means, the first and second sealing means being respectively above and below the form box, the second sealing means is lifted against the bottom of the form box and lifts the form box up against the first sealing means, suction is applied to the second sealing means, the fluid hardening medium is introduced between the first and second diaphragms, and the second sealing means is lowered to lower the form box away from the first sealing means.

4. Apparatus for preparing a foundry form, comprising:

a form box a pair of opposed sealing means for sealing against opposite ends of the form box, the first sealing means covering an open end of the form box and comprising a first, fluid-pervious, flexible diaphragm backed by a second, impervious, flexible diaphragm, and the second sealing means sealing against at least one aperture in the opposite end of the form box;

means adjacent to the top of the form box for retaining the first and second sealing means against the respective ends of the form box;

means associated with the form box for applying suction to the second sealing means to draw the second diaphragm against the first diaphragm and the first diaphragm against the surface of the mixture in the form box to compact the mixture; and means associated with the form box for subsequently introducing a fluid hardening medium between the first and second diaphragms so that it passes through the first diaphragm, penetrates the mixture within the form box, and causes the binder to harden the mixture.

5. The apparatus of claim 4, and including a form box, the form box having an open top and an open bottom and means associated with the form box adjacent to the form box for retaining a pattern plate adjacent the bottom of the form box, the second sealing means being for sealing against the open bottom of the form box.

6. The apparatus according to claim 5, wherein the pattern plate is retained on spaced supports projecting from the form box walls.

7. The apparatus of claim 4 wherein the pattern plate is perforated.

8. The apparatus of claim 7, wherein the bottom of the form box is closed by the pattern plate, which is fixed within the form box.

9. The apparatus of claim 4, and including horizontal conveying means adjacent to the form box for successively carrying form boxes, and the first and second sealing means are respectively above and below the conveying means.

10. The apparatus of claim 9, wherein the first sealing means is stationary whilst the sealing means retaining means comprises means adjacent to the bottom end of the form box for lifting the second sealing means against the bottom of the form box and thus lifting the form box up against the first sealing means.

11. The apparatus of claim 4, wherein the first diaphragm is a thin, perforated sheet of elastomeric material and the second diaphragm is a thin, imperforate sheet of elastomeric material.

12. The apparatus of claim 4, wherein the first diaphragm is secured to a first frame and the second diaphragm is secured to a second frame spaced within the first frame, said introducing means comprising a duct leading to the frame-shaped gap between the first and second frames.

* * * * *

UNITED STATES PATENT AND TRADEMARK OFFICE

CERTIFICATE OF CORRECTION

PATENT NO. : 4,129,165
DATED : December 12, 1978
INVENTOR(S) : Albert Edwards

It is certified that error appears in the above-identified patent and that said Letters Patent are hereby corrected as shown below:

Column 4, line 35, delete "and including a form box,".

Column 4, lines 37 & 38, delete "adjacent to the form box".

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*